US010140922B2

(12) United States Patent
Wang et al.

(10) Patent No.: US 10,140,922 B2
(45) Date of Patent: Nov. 27, 2018

(54) PIXEL DRIVING CIRCUIT AND DRIVING METHOD THEREOF AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Guangxing Wang, Beijing (CN); Bin Zhang, Beijing (CN); Dianzheng Dong, Beijing (CN); Qiang Zhang, Beijing (CN); Kan Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 84 days.

(21) Appl. No.: 15/507,904

(22) PCT Filed: Aug. 19, 2016

(86) PCT No.: PCT/CN2016/096076
§ 371 (c)(1),
(2) Date: Mar. 1, 2017

(87) PCT Pub. No.: WO2017/118036
PCT Pub. Date: Jul. 13, 2017

(65) Prior Publication Data

US 2018/0226027 A1 Aug. 9, 2018

(30) Foreign Application Priority Data

Jan. 4, 2016 (CN) ..... 2016 1 0004492

(51) Int. Cl.
*G09G 3/3258* (2016.01)

(52) U.S. Cl.
CPC ... *G09G 3/3258* (2013.01); *G09G 2320/0233* (2013.01)

(58) Field of Classification Search
CPC ..... G09G 3/3258; G09G 2320/0233
See application file for complete search history.

(56) References Cited

U.S. PATENT DOCUMENTS 9,125,249 B2 * 9/2015 Kim ..... G09G 3/2048
9,231,039 B2 * 1/2016 Kim ..... G09G 3/3233
(Continued)

*Primary Examiner* — Peter D McLoone
(74) *Attorney, Agent, or Firm* — Ladas & Parry LLP

(57) ABSTRACT

A pixel driving circuit and a driving method thereof, and a display device are provided. The pixel driving circuit includes input module, compensation module, drive module, light emitting module and control signal input module. The input module is configured to transmit a signal of a data voltage terminal to the compensation module under control of first gate signal terminal. The compensation module is configured to compensate for a threshold voltage of the drive module under control of the input module and a threshold voltage control terminal. The drive module is configured to drive the light emitting module to emit light under control of first control signal terminal. The control signal input module is configured to transmit a signal of second voltage terminal or third voltage terminal to the first control signal terminal under control of second control signal terminal and third control signal terminal.

15 Claims, 5 Drawing Sheets

(56) References Cited

U.S. PATENT DOCUMENTS

| | | | | |
|---|---|---|---|---|
| 2014/0084805 | A1* | 3/2014 | Kim | G09G 3/2048<br>315/228 |
| 2014/0320544 | A1* | 10/2014 | Kim | G09G 3/3233<br>345/690 |
| 2018/0096654 | A1* | 4/2018 | Wang | G09G 3/3258 |
| 2018/0130412 | A1* | 5/2018 | Zhang | G09G 3/32 |

* cited by examiner

PIXEL DRIVING CIRCUIT AND DRIVING METHOD THEREOF AND DISPLAY DEVICE

TECHNICAL FIELD

The present disclosure relates to a pixel driving circuit and a driving method thereof, and a display device.

BACKGROUND

With the rapid progress of the display technique, as a core of a display device, the technique of semi-conductor elements also makes rapid progress. For the existing display device, an organic light emitting diode (OLED), as a current-type light emitting device, is increasingly applied in high performance display area due to its characteristics of self-illumination, fast response, broad view and being able be to made on a flexible substrate.

OLED can be divided into a passive matrix driving OLED (PMPLED) and an active matrix driving OLED (AMOLED) according to driving modes. AMOLED display is expected to become a next generation of new flat panel display to take the place of a liquid crystal display (LCD) because it has advantages of low manufacturing cost, fast response speed, power saving, being applicable to direct current driving of a portable device, and wide range of operation temperature, etc.

In the existing AMOLED display panel, each OLED comprises a plurality of thin film transistor (TFT) switch circuits. However, due to characteristics of polysilicon and manufacturing process, it is caused that fluctuations often occur to electrical parameters such as a threshold voltage Vth, a mobility, etc. when the TFT switch circuit is manufactured on a large-area glass substrate, such that current flowing through the OLED device in the AMOLED display panel would not only change with turn-on voltage stress caused by long turn-on of TFT but also would become different as the threshold voltage Vth of TFT drifts. In this way, brightness uniformity and brightness constancy of the display would be influenced to reduce quality of pictures of the display.

SUMMARY

There is provided in embodiments of the present disclosure a pixel driving circuit and a driving method thereof, and a display device, which are capable of improving negative phenomena of non-uniformity of display brightness of a display caused by a threshold voltage.

According to one aspect of an embodiment of the present disclosure, there is provided a pixel driving circuit, comprising an input module, a compensation module, a drive module, a light emitting module and a control signal input module; the input module is connected to a first gate signal terminal and a data voltage terminal, and the compensation module, and is configured to transmit a signal of the data voltage terminal to the compensation module under control of the first gate signal terminal. And the compensation module is connected to a threshold voltage control terminal, and the drive module, and is configured to compensate for a threshold voltage of the drive module under control of the input module and the threshold voltage control terminal; the light emitting module is connected to a first voltage terminal and the drive module; the drive module is connected to a first control signal terminal, and is configured to drive the light emitting module to emit light under control of the first control signal terminal; the control signal input module is connected to the first control signal terminal, a second control signal terminal, a third control signal terminal, a second voltage terminal and a third voltage terminal, and is configured to transmit a signal of the second voltage terminal or the third voltage terminal to the first control signal terminal under control of the second control signal terminal and the third control signal terminal.

Optionally, the input module comprises a first transistor, whose gate is connected to the first gate signal terminal, first electrode is connected to the data voltage terminal, and second electrode is connected to the compensation module.

Optionally, the compensation module comprises a second transistor and a storage capacitor; a gate of the second transistor is connected to the threshold voltage control terminal, a first electrode thereof is connected to another terminal of the storage capacitor, and a second electrode thereof is connected to the drive module.

Optionally, the drive module comprises a third transistor; a gate of the third transistor is connected to another terminal of the storage capacitor, a first electrode thereof is connected to the first control signal terminal, and a second electrode thereof is connected to the light emitting module.

Optionally, the control signal input module comprises a fourth transistor, a fifth transistor, a sixth transistor and a seventh transistor; a gate of the fourth transistor is connected to the second control signal terminal, a first electrode thereof is connected to the second voltage terminal, and a second electrode thereof is connected to the first control signal terminal; a gate of the fifth transistor is connected to the third control signal terminal, a first electrode thereof is connected to the second voltage terminal, and a second electrode thereof is connected to the first control signal terminal; a gate of the sixth transistor is connected to the second control signal terminal, a first electrode thereof is connected to the first control signal terminal, and a second electrode thereof is connected to a second electrode of the seventh transistor; a gate of the seventh transistor is connected to the third control signal terminal, and a first electrode thereof is connected to the third voltage terminal.

Optionally, the input module comprises an eighth transistor; a gate of the eighth transistor is connected to a second gate signal terminal, a first electrode thereof is connected to the data voltage terminal, and a second electrode thereof is connected to the compensation module.

According to another aspect of an embodiment of the present disclosure, there is provided a display device, comprising any one of the pixel driving circuits as described above.

Optionally, the display device further comprises a display panel having a plurality of gate lines and data lines crossed horizontally and vertically, wherein the gate lines and the data lines define a plurality of pixel units crossly; a control signal input module and a compensation module located in a first pixel unit of a J-th row and a I-th column and a control signal input module and a compensation module located in a second pixel unit of a (J+1)-th row and a (I−1)-th column are shared with each other; where $J \geq 1$, $I \geq 2$, J and I are positive integers.

Optionally, when the compensation module comprises a first transistor and an eighth transistor, the first transistor is located in the first pixel unit, and the eighth transistor is located in the second pixel unit.

According to another aspect of an embodiment of the present disclosure, there is provided a method for driving any one of the pixel driving circuit described above, comprising: in a reset phase, transmitting, by a control signal input module, a signal of a third voltage terminal to a first control signal terminal to reset a drive module; in a compensation phase, transmitting, by the control signal input module, a signal of a second voltage terminal to the first control signal terminal to turn on the drive module, and compensating for, by a compensation module, a threshold voltage of the drive module under control of an input module and a threshold voltage control terminal; in a writing phase, transmitting, by the control signal input module, a signal of a second voltage terminal to the first control signal terminal to turn on the drive module, and writing a signal input by the data voltage terminal into the drive module under control of the input module and the threshold voltage control terminal; in a light emitting phase, transmitting, by the control signal input module, the signal of the second voltage terminal to the first control signal terminal to turn on the drive module, and driving, by the drive module, a light emitting module to emit light under control of the input module and the threshold voltage control terminal.

There are provided in the embodiment of the present disclosure the pixel driving circuit and the driving method of the same, and the display device. Herein, the pixel driving circuit comprises an input module, a compensation module, a drive module, a light emitting module and a control signal input module. Alternatively, the input module is connected to a first gate signal terminal and a data voltage terminal, and the compensation module, and is configured to transmit a signal of the data voltage terminal to the compensation module under control of the first gate signal terminal. And the compensation module is connected to a threshold voltage control terminal, and the drive module, and is configured to compensate for a threshold voltage of the drive module under control of the input module and the threshold voltage control terminal. The light emitting module is connected to a first voltage terminal and the drive module. The drive module is further connected to a first control signal terminal, and is configured to drive the light emitting module to emit light under control of the first control signal terminal. The control signal input module is connected to the first control signal terminal, a second control signal terminal, a third control signal terminal, a second voltage terminal and a third voltage terminal, and is configured to transmit a signal of the second voltage terminal or the third voltage terminal to the first control signal terminal under control of the second control signal terminal and the third control signal terminal.

In this way, by adopting the control signal input module, it is enabled to transmit the signal of the second voltage terminal or the third voltage terminal to the first control signal terminal in different phases according to the requirements, so as to reset the drive module under control of the first control signal terminal or make the drive module be capable of driving the light-emitting module to emit light. Since the compensation module can compensate for the threshold voltage of the drive module before the light emitting module emits light, the problem of non-uniformity of display brightness caused by drifting of the threshold voltage can be avoided.

DETAILED DESCRIPTION

Technical solutions in embodiments of the present disclosure will be described below clearly and completely by combining with accompanying figures. Obviously, the embodiments described below are just a part of embodiments of the present disclosure rather than all the embodiments of the present disclosure.

Figure 1:
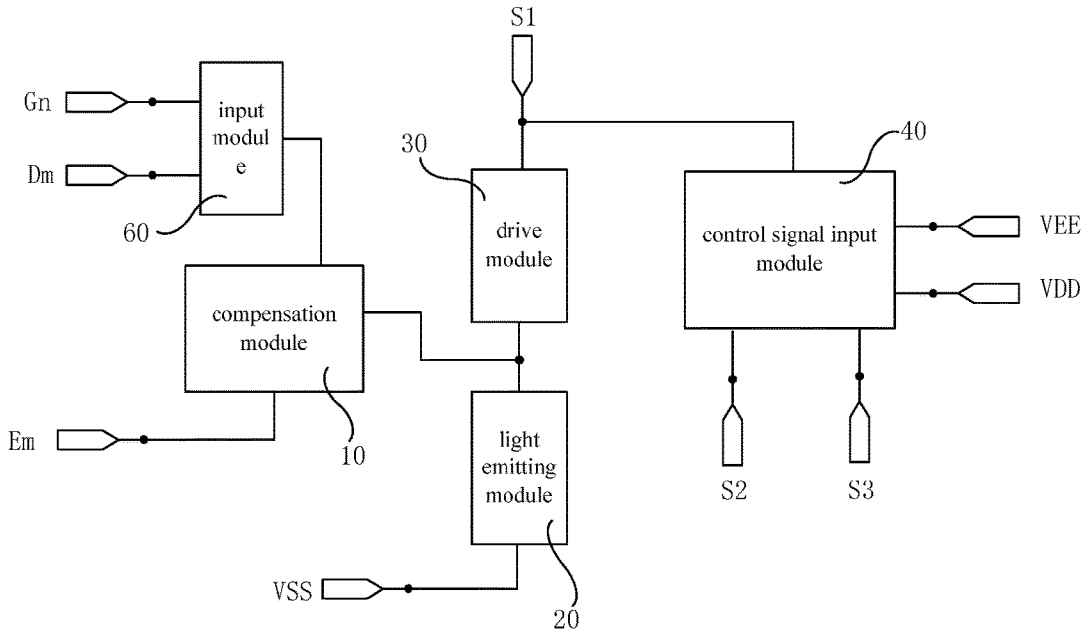
FIG. 1 is a schematic diagram of structure of a pixel driving circuit provided in an embodiment of the present disclosure.

FIG. 1 shows a schematic diagram of structure of a pixel driving circuit provided in an embodiment of the present disclosure. As shown in FIG. 1, the pixel driving circuit can comprise an input module 60, a compensation module 10, a drive module 30, a light emitting module 20 and a control signal input module 40.

In the pixel driving circuit, the input module 60 is connected to a first gate signal terminal Gn, a data voltage terminal Dm and a compensation module 10, and is configured to transmit a signal of the data voltage terminal Dm to the compensation module 10 under control of the first gate signal terminal Gn.

Besides being connected to the input module 60, the compensation module 10 is further connected to a threshold voltage control terminal Em and the drive module 30, and is configured to compensate for a threshold voltage of the drive module 30 under control of the input module 60 and the threshold voltage control terminal Em.

The light emitting module 20 is connected to a first voltage terminal VSS and the drive module 30. In this case, the drive module 30 is further connected to a first control signal terminal S1, and is configured to drive the light emitting module 20 to emit light under control of the first control signal terminal S1.

The control signal input module 40 is connected to the first control signal terminal S1, a second control signal terminal S2, a third control signal terminal S3, a second voltage terminal VDD and a third voltage terminal VEE, and is configured to transmit a signal of the second voltage terminal VDD or the third voltage terminal VEE to the first control signal terminal S1 under control of the second control signal terminal S2 and the third control signal terminal S3.

It should be noted that in the embodiments of the present disclosure, it is described by taking the first voltage terminal VSS and the third voltage terminal VEE being input a low level or being connected to a ground and the second voltage terminal VDD being input a high level as an example.

There is provided in the embodiment of the present disclosure the pixel driving circuit, comprising an input module, a compensation module, a drive module, a light emitting module and a control signal input module. Alternatively, the input module is connected to a first gate signal terminal, a data voltage terminal and the compensation module, and is configured to transmit a signal of the data voltage terminal to the compensation module under control of the first gate signal terminal. And the compensation module is further connected to a threshold voltage control terminal and the drive module, and is configured to compensate for a threshold voltage of the drive module under control of the input module and the threshold voltage control terminal. The light emitting module is connected to a first voltage terminal and the drive module. The drive module is further connected to a first control signal terminal, and is configured to drive the light emitting module to emit light under control of the first control signal terminal. The control signal input module is connected to the first control signal terminal, a second control signal terminal, a third control signal terminal, a second voltage terminal and a third voltage terminal, and is configured to transmit a signal of the second voltage terminal or the third voltage terminal to the first control signal terminal under control of the second control signal terminal and the third control signal terminal.

In this way, by adopting the control signal input module, it is enabled to transmit the signal of the second voltage terminal or the third voltage terminal to the first control signal terminal in different phases according to the requirements, so as to reset the drive module under control of the first control signal terminal or make the drive module be capable of driving the light-emitting module to emit light. Since the compensation module can compensate for the threshold voltage of the drive module before the light emitting module emits light, the problem of non-uniformity of display brightness caused by drifting of the threshold voltage can be avoided.

Specific structures of respective modules in the pixel circuit will be described in detail by combining with accompanying figures.

Figure 2:
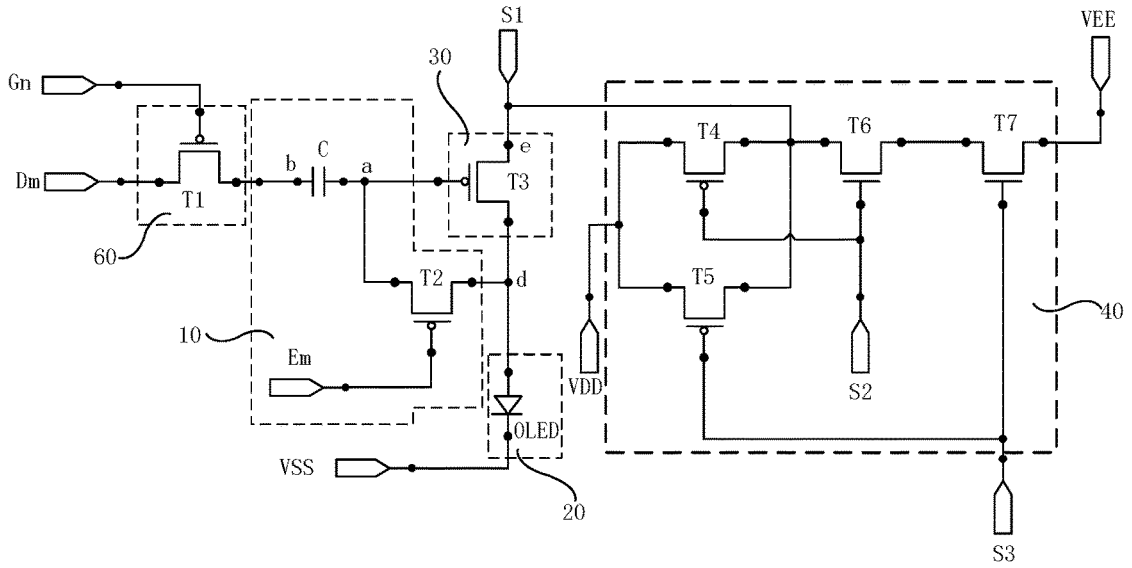
FIG. 2 is a schematic diagram of a specific structure of respective modules in FIG. 1.

FIG. 2 shows a schematic diagram of a specific structure of respective modules in FIG. 1. As shown in FIG. 2, the input module 60 can comprise a first transistor T1. A gate of the first transistor T1 is connected to a first gate signal terminal Gn, a first electrode thereof is connected to a data voltage terminal Dm, and a second electrode thereof is connected to the compensation module 10.

The compensation module 10 can comprise a second transistor T2 and a storage capacitor C. A gate of the second transistor T2 is connected to a threshold voltage control terminal Em, a first electrode thereof is connected to one terminal (node a) of the storage capacitor C, and a second electrode thereof is connected to the drive module 30. When the structure of the input module 60 is as described above, its second electrode is connected to another terminal (node b) of the storage capacitor C.

The drive module 30 can comprise a third transistor T3. In this case, when the structure of the compensation module 10 is as described above, the second electrode of the second transistor T2 is connected to a second electrode of the third transistor T3.

A gate of the third transistor T3 is connected to one terminal (node a) of the storage capacitor C, a first electrode thereof is connected to the first control signal terminal S1, and the second electrode thereof is connected to the light emitting module 20. Herein, the light emitting module 20 comprises an organic light emitting diode OLED, whose anode is connected to the drive module 30, and cathode is connected to the first voltage terminal VSS. When the structure of the drive module 30 is as described above, the anode of the organic light emitting diode OLED is connected to the second electrode of the second transistor T3.

In addition, the control signal input module 40 can comprise a fourth transistor T4, a fifth transistor T5, a sixth transistor T6 and a seventh transistor T7.

Herein, a gate of the fourth transistor T4 is connected to the second control signal terminal S2, a first electrode thereof is connected to the second voltage terminal VDD, and a second electrode thereof is connected to the first control signal terminal S1.

A gate of the fifth transistor T5 is connected to the third control signal terminal S3, a first electrode thereof is connected to the second voltage terminal VDD, and a second electrode thereof is connected to the first control signal terminal S1.

A gate of the sixth transistor T6 is connected to the second control signal terminal S2, a first electrode thereof is connected to the first control signal terminal S1, and a second electrode thereof is connected to a second electrode of the seventh transistor T7.

A gate of the seventh transistor T7 is connected to the third control signal terminal S3, and a first electrode thereof is connected to the third voltage terminal VEE.

The pixel circuit described above can be arranged in each pixel unit of the display panel. There are many kinds of arrangements for thin film transistors (TFT) on the display panel. In general, thin film transistors located in pixel units of a same column can be connected to a same data line.

Figure 3:
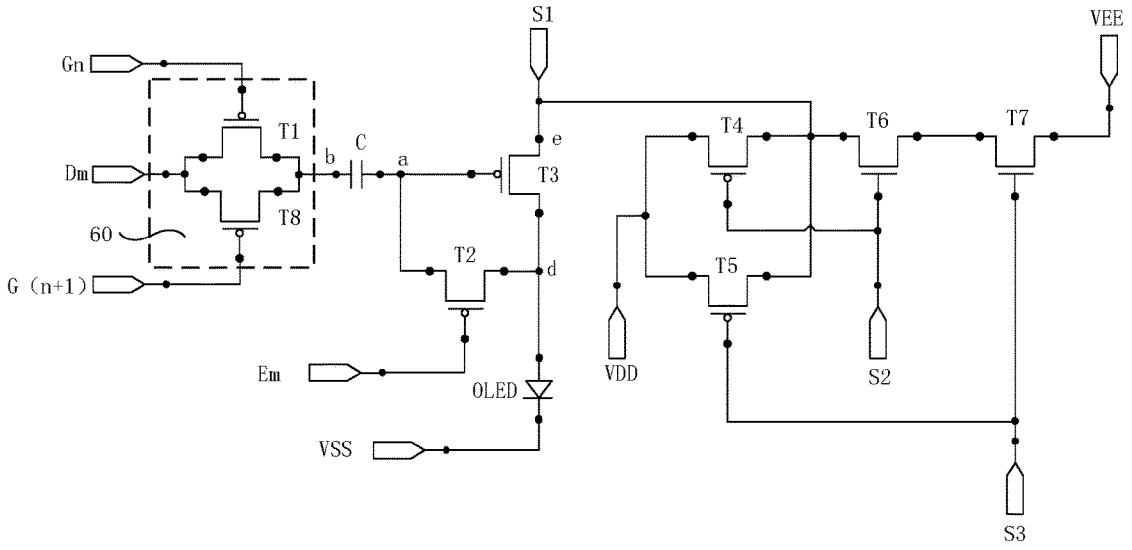
FIG. 3 is a schematic diagram of another specific structure of respective modules in FIG. 1.
Figure 4:
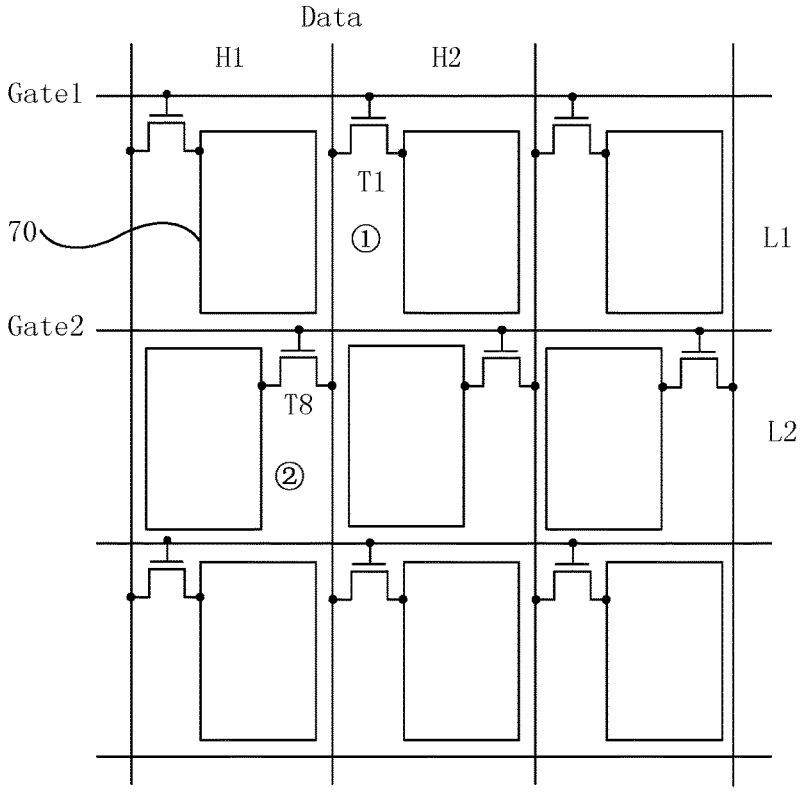
FIG. 4 is a schematic diagram of arrangement of TFTs on a display panel that adopts a pixel driving circuit in FIG. 3.

FIG. 3 shows a schematic diagram of another specific structure of the respective modules in FIG. 1. FIG. 4 shows a schematic diagram of arrangement of TFTs on a display panel that adopts the pixel driving circuit in FIG. 3.

As shown in FIG. 4, TFTs on the display panel are arranged in a Z shape. That is, TFTs in pixel units of a same column are not connected to a same data line. Instead, any random sub-pixels of two adjacent rows (L1 and L2) and two adjacent columns (H1 and H2) are connected to a same data line. By taking a first pixel unit ① and a second pixel unit ② as an example, TFTs of the first pixel unit ① and the second pixel unit ② are connected to a same data line.

In these cases, in order to realize driving of the pixel driving unit, as shown in FIG. 3, the input module 60 can comprise an eighth transistor T8. Herein, the first transistor T1 is located in the first pixel unit ①, and the eighth transistor T8 is located in the second pixel unit ②. In addition, a gate of the eighth transistor T8 is connected to a second gate signal terminal G(n+1), a first electrode thereof is connected to the data voltage terminal Dm, and a second electrode thereof is connected to one terminal (node b) of the storage capacitor C. It should be noted that a block 70 in FIG. 3 represents an omission of power devices other than the first transistor T1 or the eighth transistor T8 in the pixel driving circuit.

Alternatively, the first transistor T1 and the eighth transistor T8 share a data line Data, which is used to receive a signal input by the data voltage terminal Dm. The gate of the first transistor T1 is connected to a first gate line Gate1, which is used to receive a signal input by the first gate signal terminal Gn. A second gate line Gate2 is used to receive a signal input by the second gate signal terminal G(n+1). The first gate line Gate1 and the second gate line Gate2 are any two adjacent gate lines of all the gate lines on the display panel.

In this case, in the process of progressive scanning of the gate lines, when the first gate signal terminal G(n) is input a signal, the first transistor T1 is turned on, and the signal input by the data signal terminal Dm can be transmitted to a gate of a driving transistor (a third transistor T3) located in the first pixel unit ① through the first transistor T1. When the second gate signal terminal G(n+1) is input a signal, the eight transistor T8 is turned on, and the signal input by the data signal terminal Dm can be transmitted to the gate of the driving transistor (the third transistor T3) located in the second pixel unit ② through the eight transistor T8, so that driving the pixel unit to emit light can be realized when TFTs takes on arrangement of Z shape.

It should be noted that transistors provided in the embodiments of the present disclosure may be N-type transistors or may be P-type transistors; or one part of the transistors are N-type transistors, and another part of the transistors are P-type transistors, to which the present disclosure does not limit. Following embodiment of the present disclosure is described by taking the first transistor T1, the second transistor T2, the third transistor T3, the fourth transistor T4, the fifth transistor T5 and the eighth transistor T8 being P-type transistors and the sixth transistor T6 and the seventh transistor T7 being N-type transistors as an example.

On such a basis, first electrodes of the transistors can be sources, and second electrodes thereof can be drains; or, first electrodes of the transistors can be drains, and second electrodes thereof can be sources, to which the present disclosure does not limit.

In addition, the above transistors may be enhancement type transistors or may be deletion type transistors, to which the present disclosure does not limit.

Figure 5:
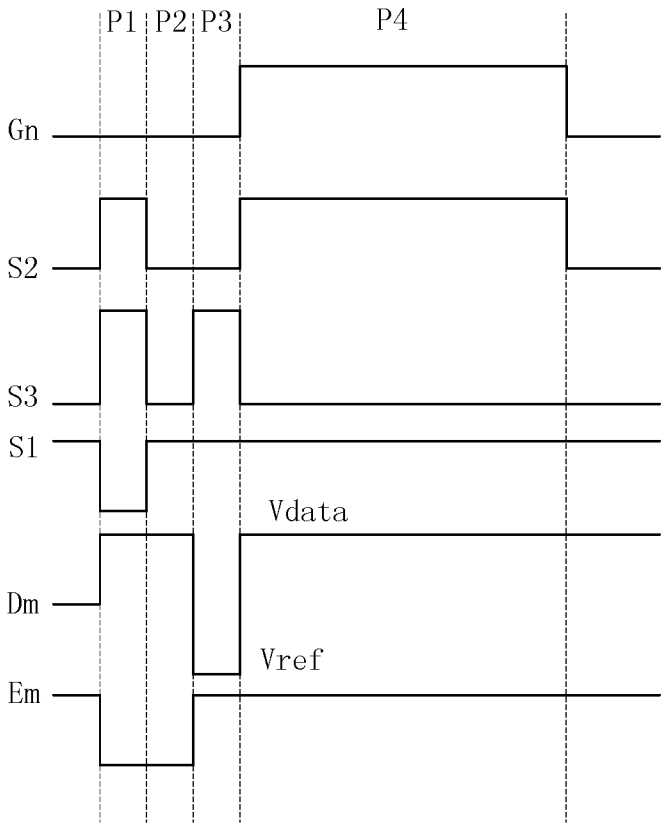
FIG. 5 is a signal timing diagram for controlling the pixel driving circuit as shown in FIG. 2 or FIG. 3.

FIG. 5 shows a signal timing diagram for controlling the pixel driving circuit as shown in FIG. 2 or 3. The driving process of the pixel driving circuit as shown in FIG. 2 or 3 will be described in detail with respect to the pixel driving circuit by combing with the signal timing diagram for controlling as shown in FIG. 5.

As shown in FIG. 5, in first phase P1, Gn=0, S1=0, S2=1, S3=1, Dm=Vdata, and Em=0, where "1" represents a high level, and "0" represents a low level.

In this case, since both the second control signal terminal S2 and the third control signal terminal S3 are input a high level, the sixth transistor T6 and the seventh transistor T7 are turned on, and the fourth transistor T4 and the fifth transistor T5 are in a turn-off state. A low level input by the third voltage terminal VEE is transmitted to the first signal control terminal S1 through the seventh transistor T7 and the sixth transistor T6.

The first gate signal terminal Gn is input a low level, the first transistor T1 is turned on, and the first data voltage Vdata input by the data voltage terminal Dm is transmitted to one terminal (node b) of the storage capacitor C through the first transistor T1. The threshold voltage control terminal Em is input a low level, and thus the second transistor T2 is turned on, such that the gate and the second electrode of the third transistor T3 which is taken as a driving transistor are turned on. In this case, since the first signal control terminal S1 is input a voltage of the third voltage terminal VEE, both the gate voltage Vg=Va of the third transistor T3 and the voltage Vd of the second electrode thereof are VEE+Vth, where Vth is a threshold voltage of the third transistor T3. At this time, a voltage difference between two terminals of the storage capacitor is Vb−Va=Vdata−VEE−Vth.

To sum up, the first phase P1 is a reset phase. The third voltage terminal VEE is input a low level, and thus it is capable of making the gate of the driving transistor (the third transistor T3) reset, so as to avoid a voltage of a previous frame picture remained in the gate of the third transistor T3 from influencing a current frame picture.

As shown in FIG. 5, in second phase P2, Gn=0, S1=1, S2=0, S3=0, Dm=Vdata, and Em=0.

In this case, since both the second control signal terminal S2 and the third control signal terminal S3 are input a low level, the fourth transistor T4 and the fifth transistor T5 are turned on, and the sixth transistor T6 and the seventh transistor T7 are in a turn-off state. High level input by the second voltage terminal VDD is transmitted to the first signal control terminal S1 through the fourth transistor T4 and the fifth transistor T5.

The first gate signal terminal Gn is input a low level, and the first transistor T1 still remains in a turn-on state. The first data voltage Vdata input by the data voltage terminal Dm is transmitted to one terminal (node b) of the storage capacitor C through the first transistor T1. The threshold voltage control terminal Em is input a low level, and thus the second transistor T2 is turned on, such that the gate and the second electrode of the third transistor T3 which is taken as the driving transistor are turned on. In this case, since the first signal control terminal S1 is input the voltage of the second voltage terminal VDD, both the voltage Va of the gate of the third transistor T3 and the voltage Vd of the second electrode thereof are VDD+Vth. At this time, a voltage difference between two terminals of the storage terminal is Vb−Va=Vdata−VDD−Vth.

To sum up, the second phase P2 is a compensation phase of the threshold voltage, and is used to compensate for the threshold voltage of the third transistor T3.

As shown in FIG. 5, in third phase P3, Gn=0, S1=1, S2=0, S3=1, Dm−Vref, and Em=1.

In this case, since the second control signal terminal S2 is input a low level, and the third control signal terminal S3 is input a high level, the fourth transistor T4 and the seventh transistor T7 are turned on, and the fifth transistor T5 and the sixth transistor T6 are in a turn-off state. High level input by the second voltage terminal VDD is transmitted to the first signal control terminal S1 through the fourth transistor T4.

In this phase, the threshold voltage control terminal Em is input a high level, such that the second transistor T2 is in a turn-off state. The first gate signal terminal Gn is input a low level, the first transistor T1 still remains in a turn-on state, and the second data voltage Vref input by the data voltage terminal Dm is transmitted to one terminal (node b) of the storage capacitor C through the first transistor T1, such that the voltage of one terminal of the storage capacitor C changes from the first data voltage Vdata into the second data voltage Vref. At this time, under the bootstrap effect of the storage capacitor, the voltage Va of another terminal (node a) of the storage capacitor is Vref−Vdata+VDD+Vth. In this case, the gate voltage of the third transistor T3 is Vg=Va=Vref−Vdata+VDD+Vth. Since the first signal control terminal S1 is input the voltage of the second voltage terminal VDD, the voltage of the first electrode (node e) of the third transistor T3 is Vs=VDD.

To sum up, the third phase P3 is a data writing phase, and is used to write the second data voltage Vref into the gate of the third transistor T3.

As shown in FIG. 5, in fourth phase P4, Gn=1, S1=1, S2=1, S3=0, Dm=Vdata, and Em=1.

In this case, since the second control signal terminal S2 is input a high level, the third control signal terminal S3 is input a low level, and thus the fifth transistor T5 and the sixth transistor T6 are turned on, and the fourth transistor T4 and the seventh transistor T7 are in a turn-off state. The high level input by the second voltage terminal VDD is transmitted to the first signal control terminal S1 through the fifth transistor T5.

The first gate signal terminal Gn is input a high level, and thus the first transistor T1 is turned off. The threshold voltage control terminal Em is input a high level, such that the second transistor T2 is in a turn-off state. At this time, the current flowing through the third transistor T3 drives the light emitting device OLED to emit light. Therefore, the fourth phase P4 is a light emitting phase.

In addition, the third transistor T3 is in a saturation region in the light emitting phase. Since the gate voltage of the third transistor T3 is Vg=Vref−Vdata+VDD+Vth, and the source voltage is Vs=VDD, it can be obtained according to current characteristics of TFT in the saturation region that the current flowing through the third transistor T3 is:

$$I = 1/2 \times K \times (Vgs - Vth)^2$$

$$= 1/2 \times K \times \{Vref - Vdata + VDD + Vth - VDD - Vth\}^2$$

$$= 1/2 \times K \times (Vref - Vdata)^2$$

Where K is a current constant related to the third transistor T3, and Vgs is a voltage of the gate of the third transistor T3 relative to the source, i.e., the voltage of the node a relative to the node e at this time.

In the prior art, Vth between different pixel units is different, and Vth in a same pixel is likely to drift as time goes on, which would cause display brightness difference. Since such difference is related with an image displayed previously, it usually takes on an image sticking phenomenon. However, it can be seen from the above formula that in the pixel driving circuit provided in the embodiments of the present disclosure, the current I flowing through the third transistor T3 is unrelated with the threshold voltage Vth of the third transistor T3. Therefore, influence on the current flowing through the light emitting device due to the inconsistent or drifting of the threshold voltage Vth of the third transistor T3 can be avoided, which improves greatly the uniformity of display brightness of the display device.

It should be noted that firstly, the above process takes the first transistor T1, the second transistor T2, the third transistor T3, the fourth transistor T4, the fifth transistor T5 and the eighth transistor T8 being P-type transistors and the sixth transistor T6 and the seventh transistor T7 being N-type transistors as an example. When the types of the above transistors change, the control signals in FIG. 5 also needs to make corresponding changes. When an N-type transistor needs to be turned on, its gate is capable of receiving a high level; and when a P-type transistor needs to be turned on, its gate is capable of receiving a low level.

Secondly, a gate line on the display panel generally adopts a mode of progressive scanning, that is, after a gate driving signal is input by the first gate signal terminal Gn to the first gate line Gate1 as shown in FIG. 4, the gate driving signal is input by the second gate signal terminal G(N+1) to the second gate line Gate2 as shown in FIG. 4.

Figure 6:
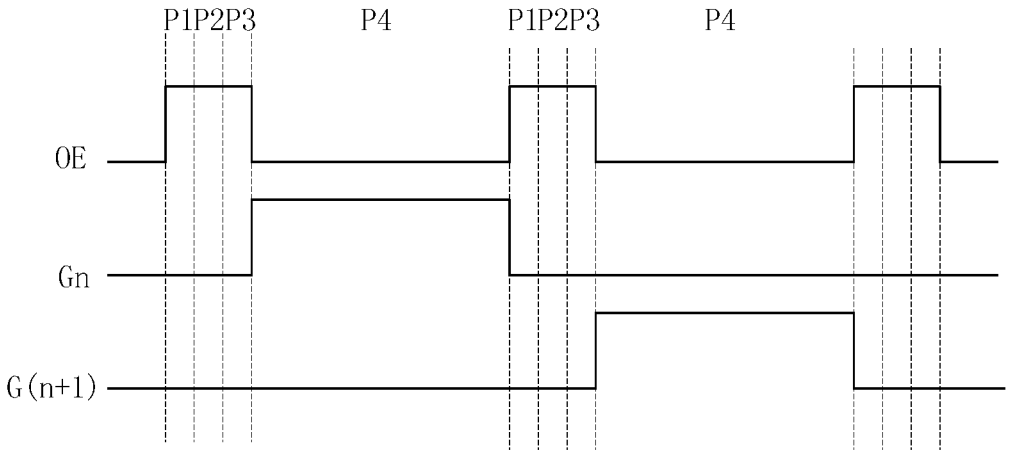
FIG. 6 is a timing diagram of a first gate signal terminal and a second gate signal terminal in FIG. 3.

FIG. 6 shows a schematic diagram of timing signals of gate lines input by the first gate signal terminal Gn and the second gate signal terminal G(n+1) in FIG. 3. As shown in FIG. 6, an enable signal terminal OE is used to input an enable signal used to control the first gate signal terminal Gn and the second gate signal terminal G(n+1). Since the first transistor T1 and the eight transistor T8 are located in two adjacent rows respectively, the above driving process is described only with respect to the first pixel unit ① having the first transistor T1. The driving process of the second pixel unit ② having the eighth transistor T8 is the same as that described above except that the eight transistor T8 is controlled to be turned on or off by the second gate signal terminal G(n+1). The specific driving process is not described herein.

There is further provided in an embodiment of the present disclosure a display device comprising any one of pixel driving circuits as described above, which has a structure and beneficial effects the same as the pixel driving circuits provided in the previous embodiments. Since the previous embodiments have described the structure and beneficial effects of the pixel driving circuits in detail, no further description is given herein.

A display device provided in the embodiments of the present disclosure can be a display device that has a current-drive light emitting device and includes a LED display or an OLED display.

Figure 7:
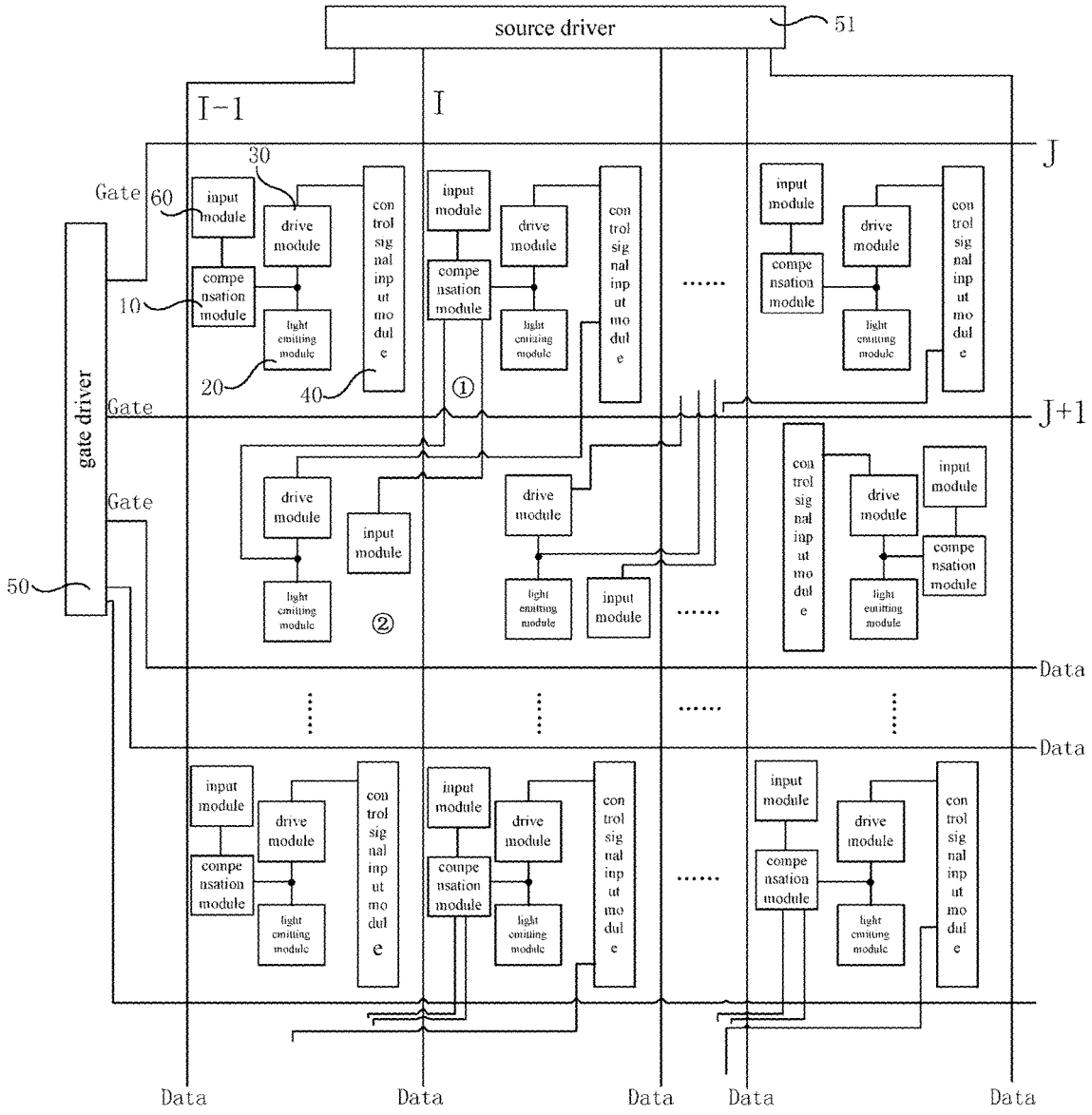
FIG. 7 is a schematic diagram of arrangement of TFTs on a display panel provided with a pixel driving circuit shown in FIG. 3.

On such a basis, it further comprises a display panel. FIG. 7 shows a schematic diagram of arrangement of TFTs on a display panel being provided with the pixel driving circuit as shown in FIG. 3. As shown in FIG. 7, the display panel has a plurality of gate lines Gate and data lines Data crossed horizontally and vertically. The gate lines Gate and the data lines Data define crossly a plurality of pixel units.

In FIG. 7, the control signal input module 40 and the compensation module 60 located in the first pixel unit ① of the J-th row and the I-th column and the control signal input module 40 and the compensation module 60 located in the second pixel unit ② of the (J+1)-th row and the (I−1)-th column can be shared, where J≥1, I≥2, and J and I are positive integers. In this way, in the above pixel driving circuit, besides the input mode 60 and the light emitting module 40, the remaining modules can share with other pixel units. Therefore, there is no need to dispose the control signal input module 60 and the light emitting module 40 in each pixel unit, so as to raise aperture ration of pixels.

When TFTs on the display panel are arranged in a Z shape, the compensation module 10 can comprise the first transistor T1 and the eighth transistor T8. In this case, as shown in FIG. 4, the first transistor T1 is located in the first pixel unit ①, and the eighth transistor T8 is located in the second pixel unit ②. In this way, in the process of progressive scanning of the gate lines, when the first gate signal terminal G(n) is input a signal, the first transistor T1 is turned on, the signal input by the data signal terminal Dm can be transmitted to the gate of the driving transistor (the third transistor T3) located in the first pixel unit ① through the first transistor T1. When the second gate signal terminal G(n+1) is input a signal, the eighth transistor T8 is turned on, the input signal of the data signal terminal Dm can be transmitted to the gate of the driving transistor (the third transistor T3) located in the second pixel unit ② through the eighth transistor T8, so as to realize driving the pixel unit to emit light when the TFTs are arranged in a Z shape.

In addition, the display panel can further comprise a gate driver 50 used to input a driving signal to the gate line Gate, and a source driver 51 used to input a data signal to the data line Date.

Figure 8:
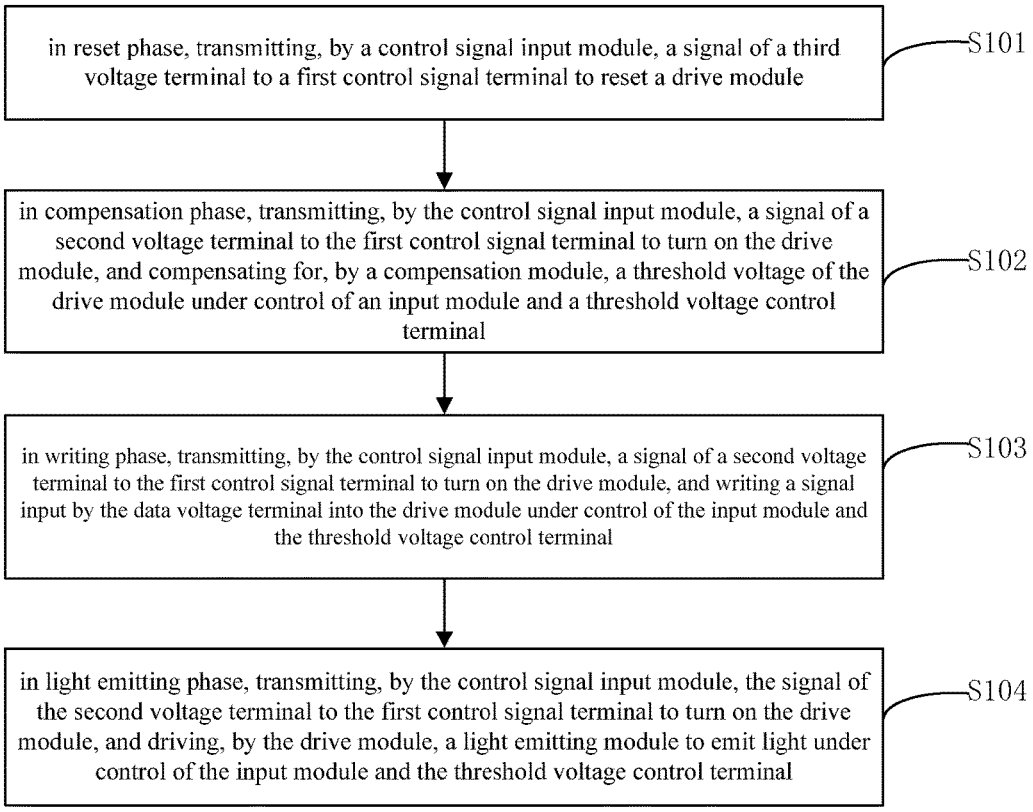
FIG. 8 is a flow chart of a driving method of a pixel driving circuit provided in an embodiment of the present disclosure.

FIG. 8 shows a flow chart of a driving method used to drive any one of the pixel driving circuits provided in an embodiment of the present disclosure. As shown in FIG. 8, the driving method comprises:

Step S101, in a reset phase, i.e., the first phase P1 as shown in FIG. 6, the control signal input module 40 inputs the signal of the third voltage terminal VEE to the first control signal terminal S1, and the drive module 30 is reset.

Alternatively, both the second control signal terminal S2 and the third control signal terminal S3 are input a high level, the sixth transistor T6 and the seventh transistor T7 are turned on, and the fourth transistor T4 and the fifth transistor T5 are in a turn-off state. Low level input by the third voltage terminal VEE is transmitted to the first signal control terminal S1 through the seventh transistor T7 and the sixth transistor T6.

The first gate signal terminal Gn is input a low level, the first transistor T1 is turned on, and the first data voltage Vdata input by the data voltage terminal Dm is transmitted to one terminal (node b) of the storage capacitor C through the first transistor T1. The threshold voltage control terminal Em is input a low level, and thus the second transistor T2 is turned on, such that the gate and the second electrode of the third transistor T3 which is taken as a driving transistor are turned on. In this case, since the first signal control terminal S1 is input a voltage of the third voltage terminal VEE, the voltage Vg=Va of the gate of the third transistor T3 and the voltage Vd of the second electrode thereof are VEE+Vth, where Vth is a threshold voltage of the third transistor T3. At this time, a voltage difference between two terminals of the storage capacitor is Vb−Va=Vdata−VEE−Vth.

Step S102, in a compensation phase, i.e., the second phase P2 as shown in FIG. 6, the control signal input module 40 inputs the signal of the second voltage terminal VDD to the first control signal terminal S1 to turn on the drive module 30; and the compensation module 10 compensates for the threshold voltage of the drive module 30 under control of the input module 60 and the threshold voltage control terminal Em.

Alternatively, since the second control signal terminal S2 and the third control signal terminal S3 are both input a low level, the fourth transistor T4 and the fifth transistor T5 are turned on, and the sixth transistor T6 and the seventh transistor T7 are in a turn-off state. High level input by the second voltage terminal VDD is transmitted to the first signal control terminal S1 through the seventh transistor T7 and the sixth transistor T6.

The first gate signal terminal Gn is input a low level, and the first transistor T1 still remains in a turn-on state. The first data voltage Vdata input by the data voltage terminal Dm is transmitted to one terminal (node b) of the storage capacitor C through the first transistor T1. The threshold voltage control terminal Em is input a low level, and thus the second transistor T2 is turned on, such that the gate and the second electrode of the third transistor T3 which is taken as the driving transistor are turned on. In this case, since the first signal control terminal S1 is input the voltage of the second voltage terminal VDD, both the voltage Va of the gate of the third transistor and the voltage Vd of the second electrode thereof are VDD+Vth. At this time, a voltage difference between two terminals of the storage terminal is Vb−Va=Vdata−VDD−Vth.

Step S103, in a writing phase, i.e., the third phase P3 as shown in FIG. 6, the control signal input module 40 inputs the signal of the second voltage terminal VDD to the first control signal terminal S1 to turn on the drive module 30, and writes the signal input by the data voltage terminal Dm into the drive module 30 under control of the input module 60 and the threshold voltage control terminal Em.

Alternatively, since the second control signal terminal S2 is input a low level and the third control signal terminal S3 is input a high level, the fourth transistor T4 and the seventh transistor T7 are turned on, and the fifth transistor T5 and the sixth transistor T6 are in a turn-off state. High level input by the second voltage terminal VDD is transmitted to the first signal control terminal S1 through the fourth transistor T4.

The threshold voltage control terminal Em is input a high level, such that the second transistor T2 is in a turn-off state. The first gate signal terminal Gn is input a low level, the first transistor T1 still remains in a turn-on state, and the second data voltage Vref input by the data voltage terminal Gm is transmitted to one terminal (node b) of the storage capacitor C through the first transistor T1, such that the voltage of one terminal of the storage capacitor C changes from the first data voltage Vdata into the second data voltage Vref. At this time, under the bootstrap effect of the storage capacitor, the voltage Va of another terminal (node a) of the storage capacitor is Vref−Vdata+Vdd+Vth. In this case, the gate voltage of the third transistor T3 is Vg=Va=Vref−Vdata+VDD+Vth. Since the first signal control terminal S1 is input the voltage of the second voltage terminal VDD, the voltage of the first electrode (node e) of the third transistor T3 is Vs=VDD.

Step S104, in a light emitting phase, i.e., the fourth phase P4 as shown in FIG. 6, the control signal input module 40 inputs the signal of the second voltage terminal VDD to the first control signal terminal S1 to turn on the drive module 30, and the drive module 30 drives the light emitting module 20 to emit light under control of the input module 60 and the threshold voltage control terminal Em.

Alternatively, the second control signal terminal S2 is input a high level, the third control signal terminal S3 is input a low level, and thus the fifth transistor T5 and the sixth transistor T6 are turned on, and the fourth transistor T4 and the seventh transistor T7 are in a turn-off state. The high level input by the second voltage terminal VDD is transmitted to the first signal control terminal S1 through the fifth transistor T5.

The first gate signal terminal Gn is input a high level, and thus the first transistor T1 is turned off. The threshold voltage control terminal Em is input a high level, such that the second transistor T2 is in a turn-off state. At this time, the current flowing through the third transistor T3 drives the light emitting device OLED to emit light. Therefore, the fourth phase P4 is a light emitting phase.

In addition, the third transistor T3 is in a saturation region in the light emitting phase. Since the gate voltage of the third transistor T3 is Vg=Vref−Vdata+VDD+Vth, and the source voltage is Vs=VDD, it can be obtained according to current characteristics of TFT in the saturation region that the current flowing through the third transistor T3 is:

$$\begin{aligned} Id &= 1/2 \times K \times (Vgs - Vth)^2 \\ &= 1/2 \times K \times \{Vref - Vdata + VDD + Vth - VDD - Vth\}^2 \\ &= 1/2 \times K \times (Vref - Vdata)^2 \end{aligned}$$

Where K is a current constant related to the third transistor T3, and Vgs is a voltage of the gate of the third transistor T3 relative to the source, i.e., the voltage of the node a relative to the node e at this time.

In the prior art, Vth between different pixel units is different, and Vth in a same pixel is likely to drift as time goes on, which would cause the display brightness difference. Since such difference is related with an image displayed previously, it usually presents an image sticking phenomenon. However, it can be seen from the above formula that in the pixel driving circuits provided in the embodiments of the present disclosure, the current Id flowing through the third transistor T3 is unrelated with the threshold voltage Vth of the third transistor T3. Therefore, influence on the current flowing through the light emitting device due to the inconsistent or drifting of the threshold voltage Vth of the third transistor T3 can be avoided, which improves greatly the uniformity of display brightness of the display device.

Those ordinary skilled in the art can understand that all or part of steps for implementing the above method embodiments can be completed by program instruction-related hardware. The program can be stored in a computer readable storage medium. When this program is executed, steps comprising the above method embodiments are executed; and the previous storage medium comprises various media that can store program codes such as ROM, RAM, a magnetic disk or an optical disk, etc.

The above descriptions are specific implementations of the present disclosure. However, the protection scope of the present disclosure is not limited thereto. Any alternations or replacements that can be easily conceived, in the technical scope disclosed in the present disclosure, by those skilled in the art who are familiar with the technical field shall be covered in the protection scope of the present disclosure. Therefore, the protection scope of the present disclosure shall be subject to the protection scope of the Claims.

The present application claims the priority of a Chinese patent application No. 201610004492.0 filed on Jan. 4, 2016. Herein, the content disclosed by the Chinese patent application is incorporated in full by reference as a part of the present disclosure.

What is claimed is:

1. A pixel driving circuit, comprising an input module, a compensation module, a drive module, a light emitting module and a control signal input module;

the input module is connected to a first gate signal terminal and a data voltage terminal and the compensation module, and configured to transmit a signal of the data voltage terminal to the compensation module under control of the first gate signal terminal;

the compensation module is connected to a threshold voltage control terminal and the drive module, and configured to compensate for a threshold voltage of the drive module under control of the input module and the threshold voltage control terminal;

the light emitting module is connected to a first voltage terminal and the drive module;

the drive module is connected to a first control signal terminal, and configured to drive the light emitting module to emit light under control of the first control signal terminal;

the control signal input module is connected to the first control signal terminal, a second control signal terminal, a third control signal terminal, a second voltage terminal and a third voltage terminal, and configured to transmit a signal of the second voltage terminal or the third voltage terminal to the first control signal terminal under control of the second control signal terminal and the third control signal terminal.

2. The pixel driving circuit according to claim 1, wherein the input module comprises a first transistor, whose gate is connected to the first gate signal terminal, first electrode is connected to the data voltage terminal, and second electrode is connected to the compensation module.

3. The pixel driving circuit according to claim 2, wherein the input module comprises an eighth transistor;

a gate of the eighth transistor is connected to a second gate signal terminal, a first electrode thereof is connected to the data voltage terminal, and a second electrode thereof is connected to the compensation module.

4. The pixel driving circuit according to claim 1, wherein the compensation module comprises a second transistor and a storage capacitor;

a gate of the second transistor is connected to the threshold voltage control terminal, a first electrode thereof is connected to another terminal of the storage capacitor, and a second electrode thereof is connected to the drive module.

5. The pixel driving circuit according to claim 1, wherein the drive module comprises a third transistor;

a gate of the third transistor is connected to another terminal of the storage capacitor, a first electrode thereof is connected to the first control signal terminal; and a second electrode thereof is connected to the light emitting module.

6. The pixel driving circuit according to claim 1, wherein the control signal input module comprises a fourth transistor, a fifth transistor, a sixth transistor and a seventh transistor;

a gate of the fourth transistor is connected to the second control signal terminal, a first electrode thereof is connected to the second voltage terminal, and a second electrode thereof is connected to the first control signal terminal;

a gate of the fifth transistor is connected to the third control signal terminal, a first electrode thereof is connected to the second voltage terminal, and a second electrode thereof is connected to the first control signal terminal;

a gate of the sixth transistor is connected to the second control signal terminal, a first electrode thereof is connected to the first control signal terminal, and a second electrode thereof is connected to a second electrode of the seventh transistor;

a gate of the seventh transistor is connected to the third control signal terminal, and a first electrode thereof is connected to the third voltage terminal.

7. A display device, comprising the pixel driving circuit according to claim 1.

8. The display device according to claim 7, further comprising a display panel having a plurality of gate lines and data lines crossed horizontally and vertically, and the gate lines and the data lines define crossly a plurality of pixel units;

a control signal input module and a compensation module located in a first pixel unit of a J-th row and a I-th column and a control signal input module and a compensation module located in a second pixel unit of a (J+1)-th row and a (I−1)-th column are shared with each other;

where $J \geq 1$, $I \geq 2$, J and I are positive integers.

9. The display device according to claim 8, wherein when the compensation module comprises a first transistor and an eighth transistor, the first transistor is located in the first pixel unit, and the eighth transistor is located in the second pixel unit.

10. The display device according to claim 7, wherein the input module comprises a first transistor, whose gate is connected to the first gate signal terminal, first electrode is connected to the data voltage terminal, and second electrode is connected to the compensation module.

11. The display device according to claim 10, wherein the input module comprises an eighth transistor;

a gate of the eighth transistor is connected to a second gate signal terminal, a first electrode thereof is connected to the data voltage terminal, and a second electrode thereof is connected to the compensation module.

12. The display device according to claim 7, wherein the compensation module comprises a second transistor and a storage capacitor;

a gate of the second transistor is connected to the threshold voltage control terminal, a first electrode thereof is connected to another terminal of the storage capacitor, and a second electrode thereof is connected to the drive module.

13. The display device according to claim 7, wherein the drive module comprises a third transistor;

a gate of the third transistor is connected to another terminal of the storage capacitor, a first electrode thereof is connected to the first control signal terminal, and a second electrode thereof is connected to the light emitting module.

14. The display device according to claim 7, wherein the control signal input module comprises a fourth transistor, a fifth transistor, a sixth transistor and a seventh transistor;

a gate of the fourth transistor is connected to the second control signal terminal, a first electrode thereof is connected to the second voltage terminal, and a second electrode thereof is connected to the first control signal terminal;

a gate of the fifth transistor is connected to the third control signal terminal, a first electrode thereof is connected to the second voltage terminal, and a second electrode thereof is connected to the first control signal terminal;

a gate of the sixth transistor is connected to the second control signal terminal, a first electrode thereof is connected to the first control signal terminal, and a second electrode thereof is connected to a second electrode of the seventh transistor;

a gate of the seventh transistor is connected to the third control signal terminal, and a first electrode thereof is connected to the third voltage terminal.

15. A method for driving the pixel driving circuit comprising an input module, a compensation module, a drive module, a light emitting module and a control signal input module, the method comprising:

in a reset phase, transmitting, by the control signal input module, a signal of a third voltage terminal to a first control signal terminal to reset a drive module;

in a compensation phase, transmitting, by the control signal input module, a signal of a second voltage terminal to the first control signal terminal to turn on the drive module, and compensating for, by the compensation module, a threshold voltage of the drive module under control of the input module and a threshold voltage control terminal;

in a writing phase, transmitting, by the control signal input module, a signal of a second voltage terminal to the first control signal terminal to turn on the drive module, and writing a signal input by the data voltage terminal into the drive module under control of the input module and the threshold voltage control terminal; and in a light emitting phase, transmitting, by the control signal input module, the signal of the second voltage terminal to the first control signal terminal to turn on the drive module, and driving, by the drive module, a light emitting module to emit light under control of the input module and the threshold voltage control terminal.

* * * * *